US009345321B1

(12) United States Patent
Yennie

(10) Patent No.: US 9,345,321 B1
(45) Date of Patent: May 24, 2016

(54) LOW PROFILE CABINET RACK

(71) Applicant: Denise J. Yennie, Kingsport, TN (US)

(72) Inventor: Denise J. Yennie, Kingsport, TN (US)

( * ) Notice: Subject to any disclaimer, the term of this patent is extended or adjusted under 35 U.S.C. 154(b) by 0 days.

(21) Appl. No.: 14/716,724

(22) Filed: May 19, 2015

(51) Int. Cl.

| | |
|---|---|
| ***A47B 73/00*** | (2006.01) |
| ***A47B 83/00*** | (2006.01) |
| ***A47B 96/20*** | (2006.01) |
| ***A47G 29/087*** | (2006.01) |
| ***A47G 29/00*** | (2006.01) |
| ***A47B 96/00*** | (2006.01) |
| ***A47B 97/00*** | (2006.01) |
| ***A47B 81/00*** | (2006.01) |
| ***A47B 77/18*** | (2006.01) |

(52) U.S. Cl.

CPC ..... *A47B 73/008* (2013.01); *A47B 77/18* (2013.01); *A47B 81/00* (2013.01); *A47B 83/00* (2013.01); *A47B 96/00* (2013.01); *A47B 97/00* (2013.01); *A47G 29/00* (2013.01); *A47G 29/087* (2013.01); *A47B 2220/0061* (2013.01); *A47B 2220/01* (2013.01)

(58) Field of Classification Search

CPC ..... A47B 2220/0061; A47B 2220/01; A47B 73/00; A47B 73/008; A47B 77/18; A47B 81/00; A47B 81/04; A47B 83/00; A47B 96/00; A47B 97/00; A47G 29/00; A47G 29/087

USPC ..... 211/87.01, 90.01, 119.004; 312/245, 312/246, 248, 405.1; D7/600.4

See application file for complete search history.

(56) References Cited

U.S. PATENT DOCUMENTS

| | | | | | |
|---|---|---|---|---|---|
| 258,720 | A | * | 5/1882 | Dickson | 223/107 |
| 363,372 | A | * | 5/1887 | Dollens | 312/291 |
| 555,446 | A | * | 2/1896 | Huber | 312/236 |
| 723,964 | A | * | 3/1903 | Wilson | 312/280 |
| 1,035,015 | A | * | 8/1912 | Johnson | 312/114 |
| 1,485,714 | A | * | 3/1924 | Roach | 312/300 |
| 1,543,980 | A | * | 6/1925 | Blood | 312/290 |
| 1,927,398 | A | * | 9/1933 | Glasser | 62/377 |
| 1,980,730 | A | * | 11/1934 | Matchette | 312/200 |
| 2,089,999 | A | * | 8/1937 | Greene | 312/245 |
| 2,135,878 | A | * | 11/1938 | Sekyra, Sr. | 62/252 |
| 2,230,975 | A | * | 2/1941 | Gratz | 312/248 |
| 2,349,391 | A | * | 5/1944 | Usoskin | 312/307 |
| 2,528,807 | A | * | 11/1950 | Whitney | 108/110 |
| 2,917,355 | A | * | 12/1959 | Squire | 312/405.1 |

(Continued)

OTHER PUBLICATIONS

Shanty2Chic. Pantry Ideas—DIY Door Spice Rack. Published Oct. 15th, 2012. Retreived Feb. 20, 2016 via the Wayback Machine, <http://www.shanty-2-chic.com/2012/10/pantry-ideas-door-spice-rack.html>.*

(Continued)

*Primary Examiner* — Joshua Rodden
(74) *Attorney, Agent, or Firm* — Shane V. Cortesi

(57) ABSTRACT

The present invention provides a low profile storage rack that attaches to the rear/interior surface of a kitchen cabinet door. The low profile storage rack includes a rear surface that confronts the rear of the door, a front surface opposite the rear surface, and a plurality of rows of ledges that extend outwardly perpendicularly relative to the storage rack width and height. Optionally, the storage rack has a low profile (thickness) so that it may fit into the unused space between the cabinet door, the cabinet face frame, and the shelves contained therein and is light weight so that the storage rack can be attached to a cabinet door with non-damaging, removable frame/poster hangers or other reusable adhesives.

21 Claims, 9 Drawing Sheets

(56) References Cited

U.S. PATENT DOCUMENTS

| | | | | | |
|---|---|---|---|---|---|
| 3,295,474 | A | * | 1/1967 | Ornstein | 108/152 |
| 3,521,936 | A | * | 7/1970 | Coker, Jr. | 312/209 |
| 4,077,520 | A | | 3/1978 | Stevenson | |
| 4,378,070 | A | * | 3/1983 | Matheis | 211/119.004 |
| D300,795 | S | * | 4/1989 | Kellogg | D6/571 |
| 5,259,517 | A | | 11/1993 | Pancoe | |
| 5,707,125 | A | * | 1/1998 | Coglin | 312/242 |
| D495,929 | S | | 9/2004 | Clarson | |
| 7,117,998 | B2 | | 10/2006 | Krapf | |
| 7,204,569 | B2 | | 4/2007 | Walburn | |
| D568,116 | S | | 5/2008 | Goodman | |
| 7,481,014 | B2 | | 1/2009 | Milburn | |
| 7,631,770 | B2 | | 12/2009 | Martin | |
| D652,684 | S | | 1/2012 | Herrera | |
| 8,113,608 | B2 | * | 2/2012 | Tassin et al. | 312/321.5 |
| 8,777,339 | B2 | * | 7/2014 | Tassin | E06B 7/34 211/119.004 |
| 2004/0178711 | A1 | * | 9/2004 | Avendano | 312/405.1 |
| 2010/0012543 | A1 | | 1/2010 | Heidrich | |
| 2011/0038564 | A1 | * | 2/2011 | Slansky | B65D 33/00 383/64 |
| 2013/0334952 | A1 | * | 12/2013 | Meese | 312/405.1 |
| 2014/0183079 | A1 | | 7/2014 | Brown | |

OTHER PUBLICATIONS

Spice Rack 18 (available at http://www.savoryspiceshop.com/spice-ware/spice-rack-18-13.75x20.5x2.75-.html) (Last Accessed Oct. 29, 2015).

Rev-A-Shelf 4SR21 Spice Rack, For 21-in Wall Cabinet (available at https://www.atgstores.com/products/view.aspx?sku=5882819 &af=3631&cse=3631&ef_ id=VgGVPAAAAcc8QSUG:20151026205628:s) (Last Accessed Oct. 29, 2015).

Adjustable Door Mount Wood Spice Rack (available at https://www.rtacabinetstore.com/RTA-Kitchen-Cabinet-Storage-Solutions/spice-racks/adjustable-door-mount-wood-spice-rack) (Last Accessed Oct. 29, 2015).

Door Mount Wood Spice Rack (available at https://www.rtacabinetstore.com/RTA-Kitchen-Cabinet-Storage-Solutions/spice-racks/door-mount-wood-spice-rack) (Last Accessed Oct. 29, 2015).

Manuela Williams, Creative & Inexpensive Organizing Ideas, available at http://acultivatednest.com/2013/09/creative-inexpensive-organizing-ideas/ (Last Accessed Feb. 23, 2016).

* cited by examiner

LOW PROFILE CABINET RACK

BACKGROUND

1. Technical Field

The present invention relates to an accessory for a cabinet, more particularly, to a lightweight, low profile rack that attaches to the inside of a kitchen cabinet door utilizing the unused space between the cabinet door, the cabinet face frame, and the shelves contained therein. The rack is lightweight, even when full with a plurality of spice and other food packets, and thus, can be attached to a cabinet door with non-damaging, removable frame/poster hangers or other reusable adhesives.

2. Background of the Invention

Spices and food seasonings are typically sold in cylindrical containers by companies such as McCormick & Co., Inc. (Sparks, Md.). Unfortunately, many modern kitchens, especially in urban areas, lack storage space for these rather bulky cylindrical containers, or the storage racks in existence to hold these containers protrude into the shelves within the cabinet, encroaching on the objects inside. Additionally, existing racks generally require screws to attach to the cabinet door, which could damage the cabinet door.

United States Patent Application 2014/0183079 teaches a low profile storage rack system that uses special containers with magnets that stick to a magnetic backboard. Unfortunately, this system does not accommodate any other type or non-magnetic food containers to be used with this system.

Thus, there is a continuing need for new, low profile storage rack systems.

BRIEF SUMMARY

The present disclosure provides a low profile storage rack system. In some embodiments, the storage rack system includes:

a storage rack comprising a rear surface configured to confront an interior surface of a cabinet door, a front surface opposite the rear surface, a thickness extending from the front surface to the rear surface, a top end, a bottom end, a height extending from the top end to the bottom end, a left side, a right side, a width extending from the left side to the right side, a plurality of rows of ledges extending generally perpendicular relative to the storage rack width and storage rack height, each ledge having a length generally parallel to the storage rack width and a ledge depth generally perpendicular to the storage rack width and the storage rack height; and a fastener configured to attach the storage rack to the interior surface of the cabinet door, wherein the median depth of each ledge is from about 0.5 inches to about 0.75 inches Optionally, the weight of the storage rack is between about 1 and about 2.5 pounds. Optionally, each ledge comprises a rear end and a front end opposite the rear end and further wherein the median distance between the front end of the ledges and the rear surface of the storage rack is between about 0.625 inches and about 1 inch. Optionally, the area between adjacent ledges is substantially hollow. Optionally, the ledges are integral with the storage rack rear surface. Optionally, the storage rack further comprises a frame and the ledges are removably attached to the storage rack frame. Optionally, the storage rack further comprises a left rail forming the left side of the storage rack, the left rail comprising a height generally parallel to the rack height, a right rail forming the right side of the storage rack, the right rail comprising a height generally parallel to the left rail height and rack height. Optionally, the storage rack is generally rectangular in shape. Optionally, the storage rack further comprises at least one horizontal rail, the at least one horizontal rail extending from the left rail to the right rail and generally parallel to the rack width. Optionally, the at least one horizontal rail is located about 0.75 inches to about 1.25 inches above a ledge. Optionally, the storage rack further comprises a plurality of rows of horizontal rails, each horizontal rail extending from the left rail to the right rail and generally parallel to the rack width. Optionally, each horizontal rail is located about 0.75 inches to about 1.25 inches above a ledge. Optionally, the storage rack further comprises a backing, the backing having a rear surface forming the rear surface of the storage rack and a front surface and further wherein the left and right rails and ledges are attached to the front surface of the backing. Optionally, each ledge is located between about 3.25 inches and 4 inches apart. Optionally, the storage rack width is less than the rack height and the rack width is between about 10 inches and about 17 inches. Optionally, the storage rack height is between about 12 inches and about 24 inches. Optionally, the fastener is an adhesive. Optionally, the adhesive is a reusable double-sided adhesive. Optionally, each ledge extends substantially the entire width of the storage rack. Optionally, at least one food packet is positioned on the ledge. Optionally, the median ledge depth is less than the median storage rack thickness. Optionally, the median ledge width is less than the median storage rack width.

In yet further embodiments, the storage rack system includes:

a cabinet comprising an interior, an exterior and a cabinet door separating the interior from the exterior, the cabinet door pivotably attached to the cabinet and configured to pivot between an open and a closed position, the cabinet door comprising an interior surface facing the cabinet interior when the cabinet door is in the closed position and an exterior surface opposite the interior surface; and a storage rack comprising a rear surface confronting an interior surface of the cabinet door, a front surface opposite the rear surface, a thickness extending from the front surface to the rear surface, a top end, a bottom end, a height extending from the top end to the bottom end, a left side, a right side, a width extending from the left side to the right side, a plurality of rows of ledges extending generally perpendicular relative to the front surface, each ledge having a length generally parallel to the storage rack width and a ledge depth generally perpendicular to the storage rack width and the storage rack height, wherein the median depth of each ledge is from about 0.5 inches to about 0.75 inches.

Optionally, the system further includes a fastener located between the storage rack rear surface and the cabinet door interior surface, the fastener attaching the storage rack to the interior surface of the cabinet door. Optionally, the cabinet interior further comprises at least one shelf. In addition, the storage rack may have the weight, dimensions and features described above, including without limitation, the frame, rails, backing and food packets.

DETAILED DESCRIPTION

Figure 1:
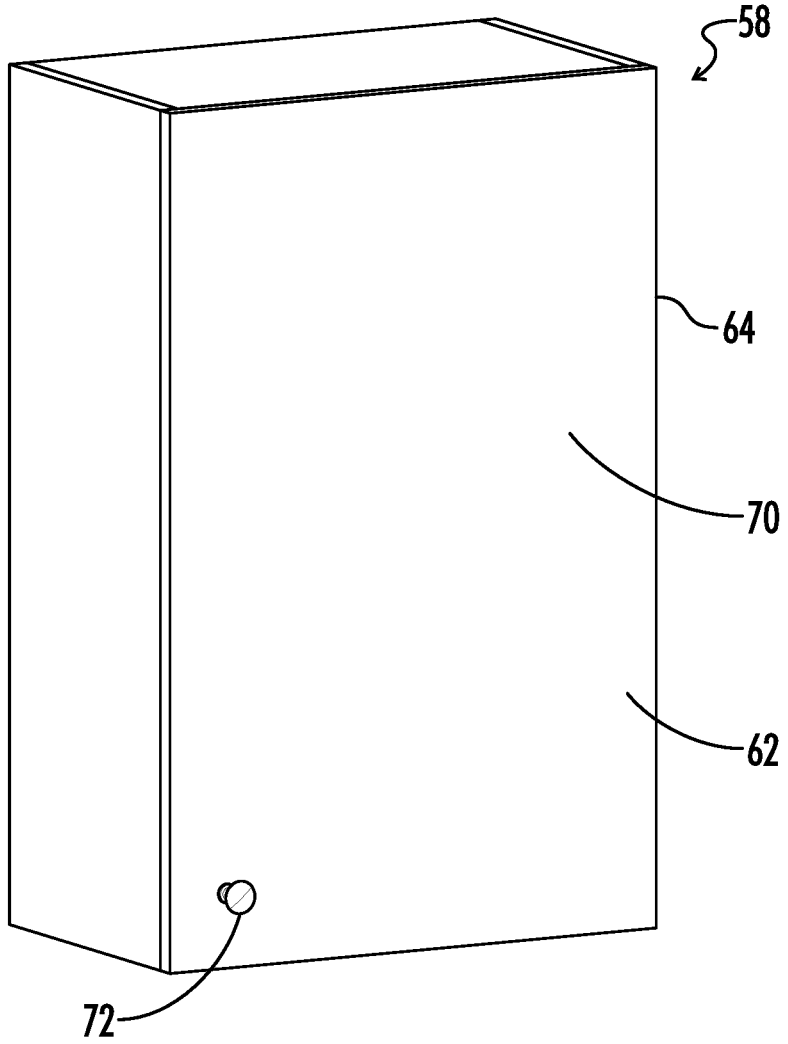
FIG. 1 illustrates an isometric view of an exterior surface of one embodiment of a cabinet that is used with the storage rack system of the present invention; the cabinet door is in the closed position.
Figure 2:
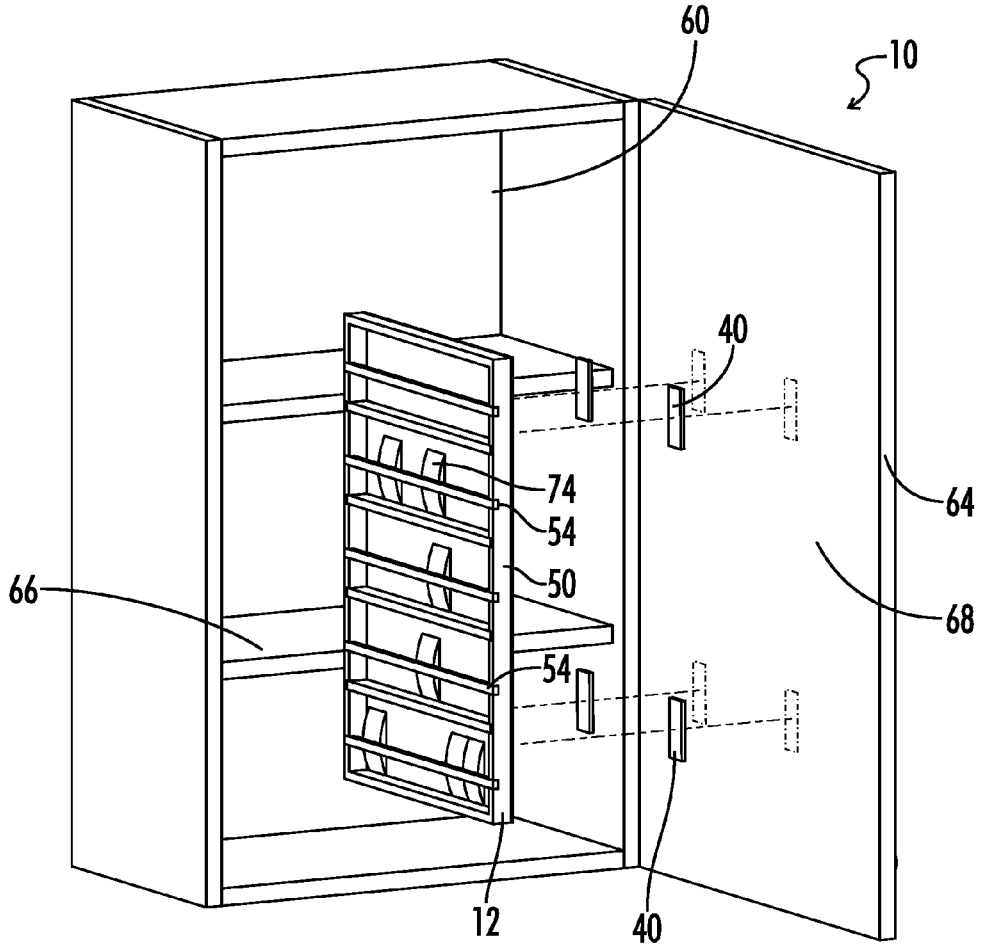
FIG. 2 illustrates an exploded, isometric view of a storage rack of one embodiment of the present invention attaching to the interior surface of the cabinet door of FIG. 1 using four, non-damaging fasteners; the cabinet door is in the open position, revealing the interior shelves in the cabinet and the storage rack is holding a plurality of food packets.
Figure 3:
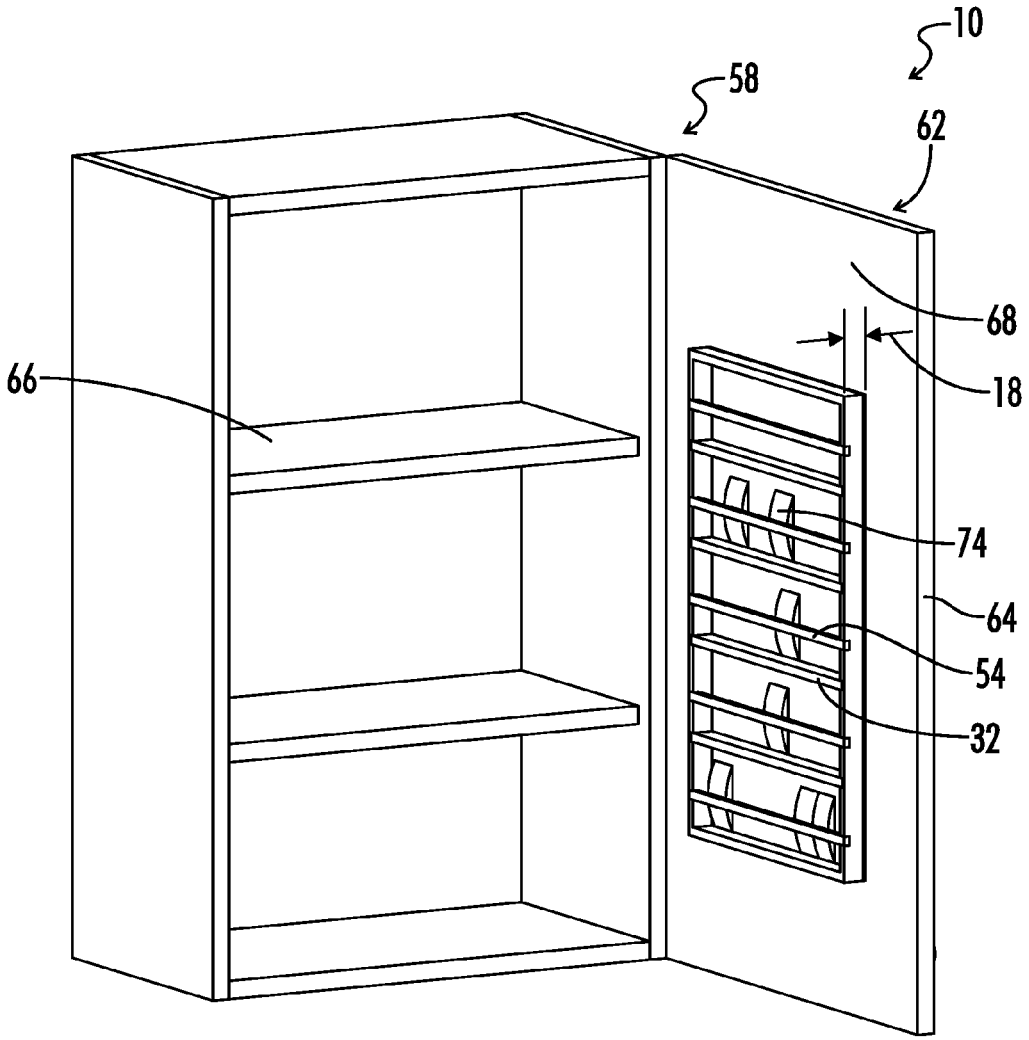
FIG. 3 illustrates an isometric view of the storage rack of FIG. 2 attached to the interior surface of the cabinet door of FIG. 1; the cabinet door is in the open position, revealing the interior shelves in the cabinet and the storage rack with contents not impeding the shelving space.
Figure 4:
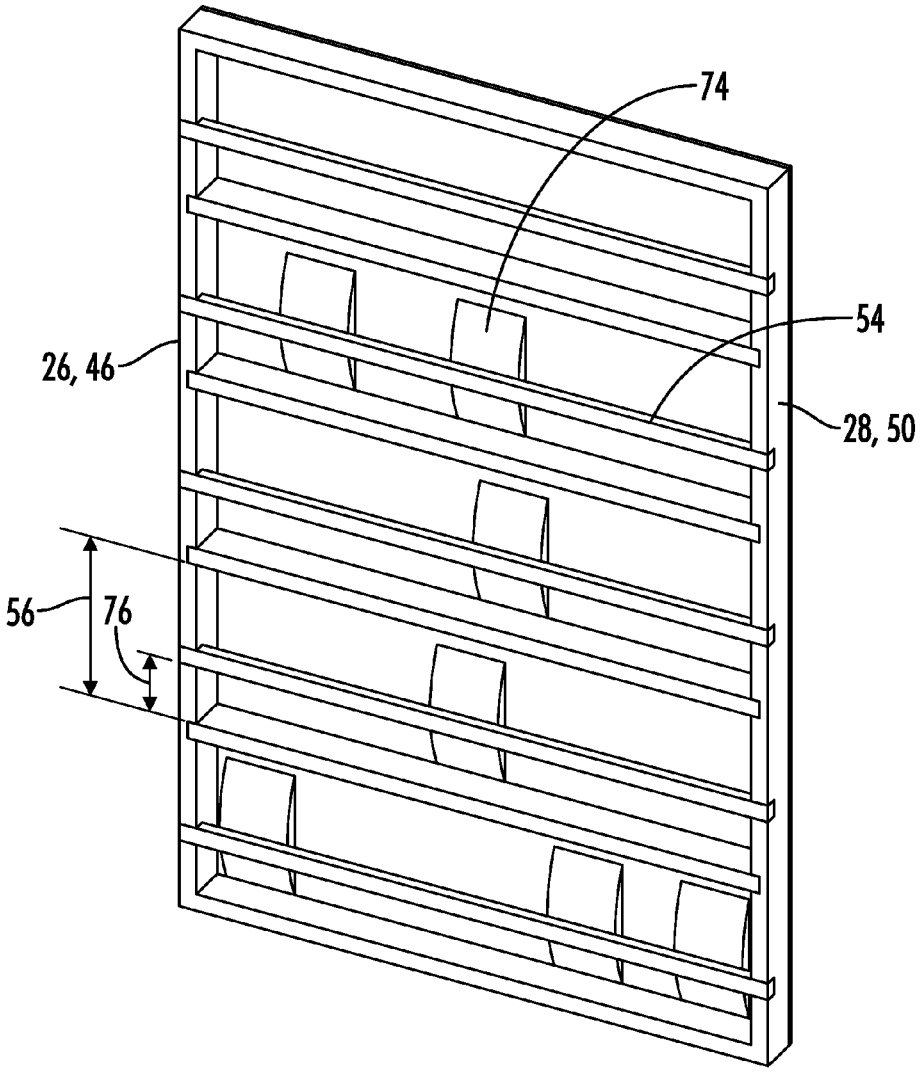
FIG. 4 illustrates an isometric view of the storage rack of FIG. 2.
Figure 5:
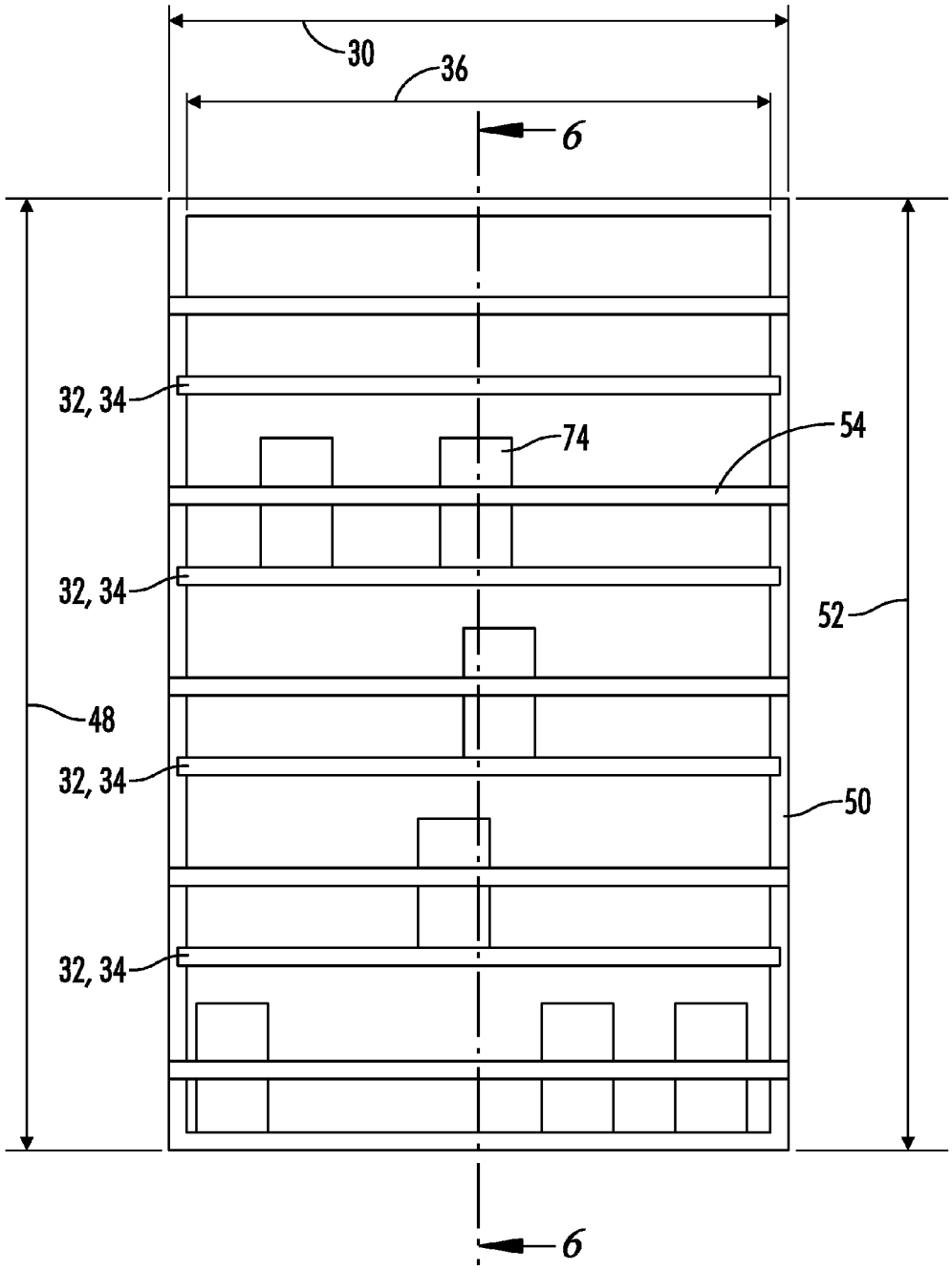
FIG. 5 illustrates a front, elevation view of the storage rack of FIG. 2.
Figure 6:
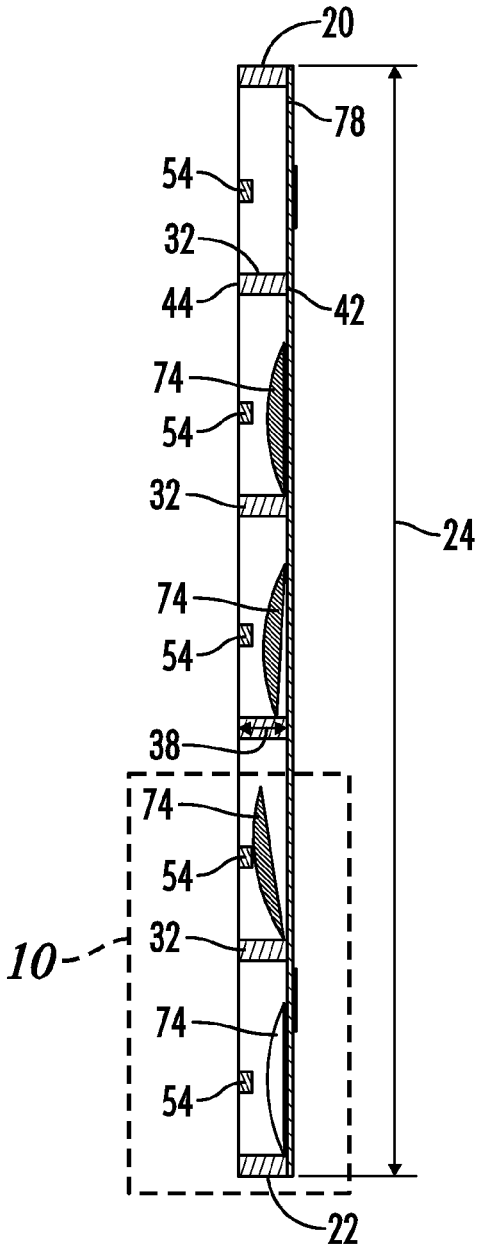
FIG. 6 illustrates, a right side, cross-sectional view of the storage rack of FIG. 5, taken along line 6-6 of FIG. 5.
Figure 7:
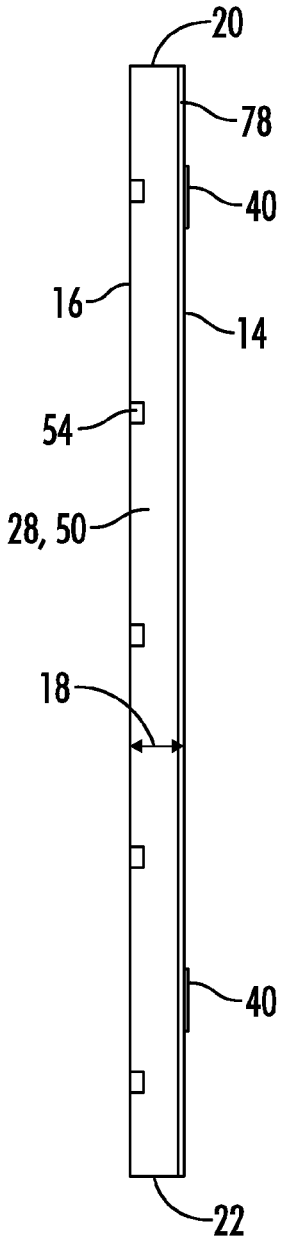
FIG. 7 illustrates a right side, elevation view of the storage rack of FIG. 2.

With reference to FIGS. 1-10 the present disclosure provides a low profile storage rack system designated by the numeral 10. In the drawings, not all reference numbers are included in each drawing for the sake of clarity.

Referring to FIGS. 1-10 the present disclosure provides a low profile storage rack system 10 comprising: a storage rack 12 comprising a rear surface 14 configured to confront an interior (rear) surface 68 of a cabinet door 64, a front surface 16 opposite the rear surface 14, a thickness 18 extending from the front surface 16 to the rear surface 14, a top end 20, a bottom end 22, a height 24 extending from the top end 20 to the bottom end 22, a left side 26, a right side 28, a width 30 extending from the left side 26 to the right side 28, a plurality of rows 34 of ledges 32 extending generally perpendicular relative to the storage rack width 30 and storage rack height 24, each ledge 32 having a length 36 generally parallel to the storage rack width 30 and a ledge depth 38 generally perpendicular to the storage rack width 30 and the storage rack height 24; and a fastener 40 configured to attach the storage rack 12 to the interior surface 68 of the cabinet door 64.

Optionally, the median depth 38 of each ledge 32 is from about 0.5 inches to about 0.75 inches. Optionally, each ledge 32 comprises a rear end 42 and a front end 44 opposite the rear end 42 and further wherein the median distance between the front end 44 of the ledges 32 and the rear surface 14 of the storage rack 12 is between about 0.625 inches and about 1 inch. In other words, preferably the rack thickness 18 is between about 0.625 inches and about 1 inch. (The front end 44 is the forward edge of the ledge 32). Without being bound by any particular theory, it is believed that such dimensions allow the storage rack 12 not to interfere with the cabinet door 64 closing. Optionally, the ledge 32 includes a raised lip 83 or a v-shaped groove 84 to assist in holding the food containers 74 to the storage rack 12.

Figure 8:
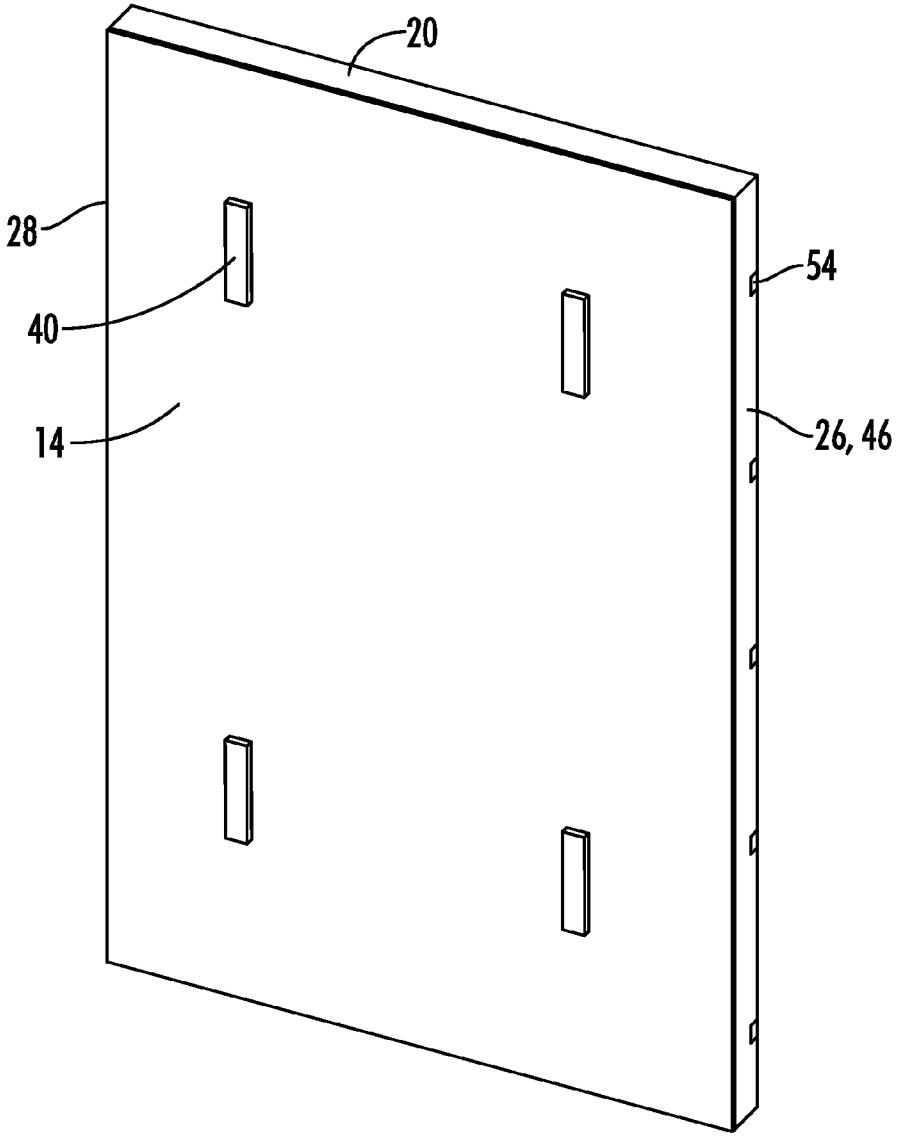
FIG. 8 illustrates a rear, elevation view of the storage rack of FIG. 1.
Figure 9:
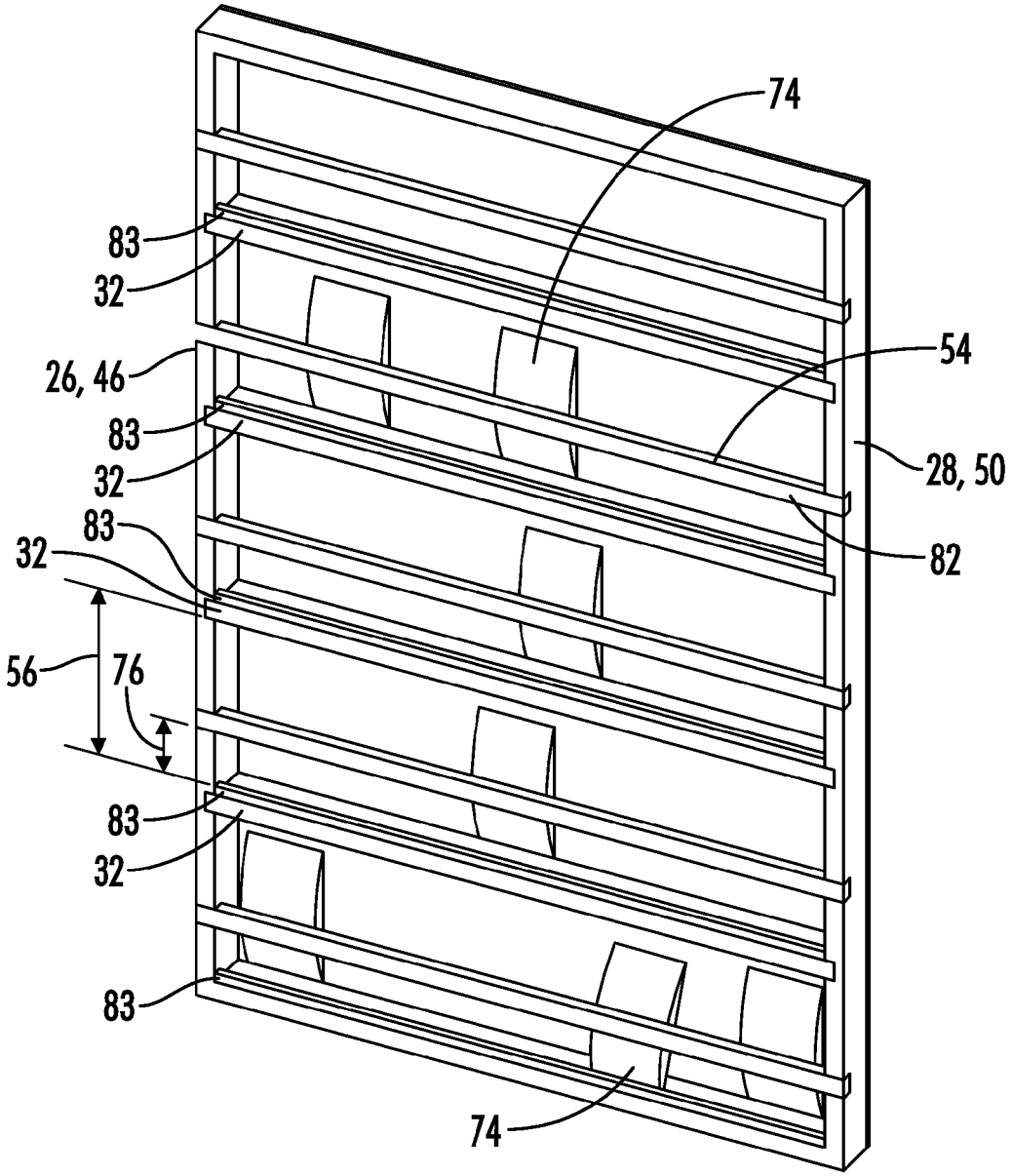
FIG. 9 illustrates a front, elevation view of a storage rack of another embodiment of the present invention; the ledges of the storage rack of FIG. 9 include lips.
Figure 10:
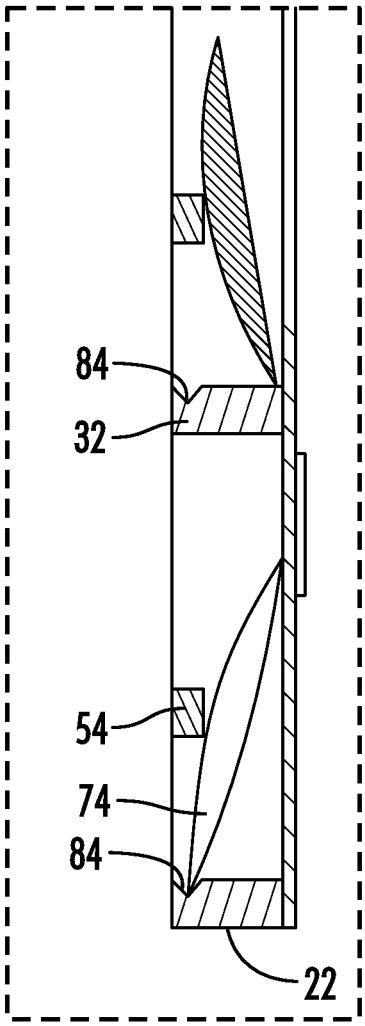
FIG. 10 illustrates a close-up of the rectangular box shown in the cross-sectional view of FIG. 6 with an alternate ledge design, namely a v-shaped groove in the ledges to assist in holding the containers on the ledges.

The front of the storage rack 12 is generally open so that food packets (preferably rectangular, reclosable, oxygen and moisture resistant bags containing spices) can be placed on and removed from the ledges 32 easily. The rear of the storage rack 12 is preferably substantially solid, as best seen in FIG. 8. For example, the storage rack 12 further may comprise a solid backing 78 that extends substantially (e.g., between about 90% and 100%) the entire width 30 and height 24 of the storage rack 12, the backing having a generally flat rear surface forming the rear surface 14 of the storage rack 12 and a front surface and further wherein the left 46 and right rails 50 and the ledges 32 are attached to the front surface of the backing 78. Optionally, the thickness (i.e., the distance between the front and rear surface of the backing 78) is between about 0.0625 inches and about 0.1875 inches. The rear surface of the backing 78 provides a smooth surface on which a reusable adhesive fastener 40 can be used to attach the storage rack 12 to the cabinet door 64. The backing 78 may be integral with the rest of the storage rack 12 (e.g., at least left and right rails 46 and 50) or may be a board that the left and right rails 46 and 50 attach to.

Optionally, each ledge 32 is located between about 3.25 inches and 4 inches apart. Optionally, the weight of the storage rack 12 is between about 1 pound and about 2.5 pounds, which allows the storage rack 12 to be secured to the cabinet door 64 with a reusable fastener 40, such as a double-sided adhesive if needed. Double-sided adhesives are known in the art and include, for example, removable frame/poster hangers such as 3M COMMAND STRIPS (3M Company, St. Paul, Minn.). Optionally, the area between adjacent ledges 32 is substantially hollow. In some embodiments, the ledges 32 are integral with the storage rack rear surface 14, which may be the case if for example, the storage rack system 10 is comprised of a single piece of plastic. In other embodiments, the ledges 32 are removably attached to the frame of the storage rack, which may be the case if for example the ledges 32 and storage rack rear surface 14 are comprised of separate pieces of wood. Optionally, the storage rack 12 further comprises a left rail 46 forming the left side 26 of the storage rack 12, the left rail 46 comprising a height 48 generally parallel to the rack height 24, a right rail 50 forming the right side 28 of the storage rack 12, the right rail 50 comprising a height 52 generally parallel to the left rail height 46 and rack height 24. Optionally, the right rail 50 and left rail 46 each have a median thickness 80 and 81 generally parallel to the rack thickness 18 of between about 0.5 inches and about 0.75 inches.

Optionally, the storage rack 12 is generally rectangular in shape. Optionally, the storage rack 12 further comprises at least one horizontal rail 54, the at least one horizontal rail 54 extending from the left rail 46 to the right rail 50 and generally parallel to the rack width 30. Optionally, the horizontal rail 54 is located about 0.75 inches to about 1.25 inches directly above a ledge 32. Optionally, the storage rack 12 further comprises a plurality of rows of horizontal rails 54, each horizontal rail 54 extending from the left rail 46 to the right rail 50 and generally parallel to the rack width 30. Optionally, the horizontal rails 54 and ledges 32 are generally parallel. Optionally, each horizontal rail 54 is located about 0.75 inches to about 1.25 inches above a ledge 12, meaning the distance 76 between a ledge 32 and an adjacent horizontal rail 54 above the ledge 32 is about 0.75 inches to about 1.25 inches). Preferably the distance 56 between adjacent ledges 32 is between about 3.25 and 4 inches. Optionally, the front ends 82 of the horizontal rails 54 are co-planar with the front ends 44 of the ledges 32. Optionally, the storage rack width 30 is less than the rack height 24 and the rack width 30 is between about 10 inches and about 17 inches. Optionally, the storage rack height 24 is between about 12 inches and about 24 inches. Optionally, each ledge 32 extends substantially the entire width 30 of the storage rack 12. For example, preferably the median ledge width 36 is between about 90% and about 100% of the median width 30 of the storage rack 12.

Optionally, the median ledge width 36 is less than the median storage rack width 30, due to the fact that the ledges 32 are preferably connected to the left and right rails 46 and 50. The storage rack 12 is comprised of any suitable material (plastic, wood including processed wood such as fiberboard, press board, metal, and the like). Optionally, at least one food packet 74 is positioned on the ledge 32 and is held in place on the storage rack 12 by a horizontal rail 54. Optionally, the median ledge depth 38 is less than the median storage rack thickness 18, which is the case if the storage rack 12 includes a backing 78. The exterior surface 70 of the cabinet door 64 further may or may not include a handle 72. Optionally, the cabinet 58 includes an exterior 62 and an interior 60 and the interior 60 further comprises at least one shelf 66.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A low profile storage rack system comprising:

a) a storage rack comprising:

i) a backing comprising a rear surface configured to confront an interior surface of a cabinet door, a front surface opposite the rear surface, a backing thickness extending from the front surface to the rear surface, a backing top end, a backing bottom end, a backing height extending from the backing top end to the backing bottom end, a backing left side, a backing right side, a backing width extending from the backing left side to the backing right side;

ii) a plurality of rows of ledges extending generally perpendicular relative to the backing height, each ledge flush with the front surface of the backing and having a ledge length generally parallel to the backing width and a median ledge depth generally parallel to the backing thickness, the median ledge depth of each ledge being from about 0.5 inches to about 0.75 inches;

iii) a left rail extending from the front surface of the backing generally perpendicular to the backing width, the left rail comprising a left rail height generally parallel to the backing height;

iv) a right rail extending from the front surface of the backing generally perpendicular to the backing width, the right rail comprising a right rail height generally parallel to the backing height; and v) a plurality of rows of horizontal rails spaced about the backing height and extending from the left rail to the right rail and generally parallel to the backing width, each horizontal rail located about 0.75 inches to about 1.25 inches above a respective one of the ledges;

b) a fastener configured to attach the storage rack to the interior surface of the cabinet door; and c) a plurality of generally rectangular bags, each bag having a bag bottom end contacting a respective one of the ledges and the front surface of the backing, a bag top end, and a bag middle portion located between the bag top end and the bag bottom end, the bag middle portion contacting a respective one of the horizontal rails, wherein each ledge comprises a left side flush with the left rail and a right side flush with the right rail, wherein the backing extends from the left rail to the right rail, wherein the backing extends between the plurality of ledges, and further wherein each ledge comprises a top surface, and a v-shaped groove located on the top surface and extending along the length of the ledge.

2. The low profile storage rack system of claim 1, wherein the storage rack has a weight of between about 1 pound and about 2.5 pounds.

3. The low profile storage rack system of claim 1, wherein each ledge comprises a rear end flush with the front surface of the backing and a front end opposite the rear end and further wherein the front ends of the ledges are located not more than about 1 inch from the rear surface of the backing.

4. The low profile storage rack system of claim 1, wherein the low profile storage rack system comprises substantially hollow areas between adjacent ones of the ledges.

5. The low profile storage rack system of claim 1, wherein the plurality of generally rectangular bags are reclosable and oxygen and moisture resistant.

6. The low profile storage rack system of claim 1, wherein the storage rack is generally rectangular in shape.

7. The low profile storage rack system of claim 1 wherein each ledge is integral with the backing.

8. The low profile storage rack system of claim 1 wherein each ledge is attached to the backing.

9. The low profile storage rack system of claim 1 wherein the storage rack comprises a storage rack height generally parallel to the backing height and further wherein the left rail height and the right rail height are substantially equal to the storage rack height.

10. The low profile storage rack system of claim 1, wherein each ledge further comprises a raised lip extending upwardly from each ledge, each raised lip extending from the left rail to the right rail, each raised lip comprising a lip height generally parallel to the backing height.

11. The low profile storage rack system of claim 1, wherein each ledge is located between about 3.25 inches and 4 inches apart.

12. The low profile storage rack system of claim 1, wherein the storage rack comprises a storage rack width generally parallel to the backing width and a storage rack height generally parallel to the backing height, and further wherein the storage rack width is less than the storage rack height and the storage rack width is between about 10 inches and about 17 inches.

13. The low profile storage rack system of claim 12, wherein the storage rack height is between about 12 inches and about 24 inches.

14. The low profile storage rack system of claim 1, wherein the fastener is an adhesive.

15. The low profile storage rack system of claim 14, wherein the adhesive is a removable double-sided adhesive.

16. The low profile storage rack system of claim 1, wherein each ledge comprises a bottom surface, a ledge height extending from the top surface to the bottom surface and generally parallel to the backing height.

17. The low profile storage rack system of claim 1 wherein each horizontal rail comprises a front end and each ledge comprises a rear end flush with the front surface of the backing and a front end opposite the rear end and further wherein the front end of each rail is generally co-planar with the front ends of the other ones of the horizontal rails.

18. The low profile storage rack system of claim 1 further comprising a cabinet comprising an interior comprising at least one shelf, an exterior and a cabinet door separating the interior from the exterior, the cabinet door pivotably attached to the cabinet and configured to pivot between an open and a closed position, the cabinet door comprising an interior surface facing the cabinet interior when the cabinet door is in the closed position and an exterior surface opposite the interior surface, wherein the rear surface of the backing is attached to the interior surface of the cabinet door by the fastener and further wherein the storage rack does not interfere with the cabinet door closing.

19. A low profile storage rack system comprising:

a) a storage rack comprising:

i) a backing comprising a rear surface configured to confront an interior surface of a cabinet door, a front surface opposite the rear surface, a backing thickness extending from the front surface to the rear surface, a backing top end, a backing bottom end, a backing height extending from the backing top end to the backing bottom end, a backing left side, a backing right side, a backing width extending from the backing left side to the backing right side;

ii) a plurality of rows of ledges extending generally perpendicular relative to the backing height, each ledge flush with the front surface and having a ledge length generally parallel to the backing width and a median ledge depth generally parallel to the backing thickness, the median ledge depth of each ledge being from about 0.5 inches to about 0.75 inches;

iii) a left rail extending from the front surface of the backing generally perpendicular to the backing width, the left rail comprising a left rail height generally parallel to the backing height;

iv) a right rail extending from the front surface of the backing generally perpendicular to the backing width, the right rail comprising a right rail height generally parallel to the backing height; and v) a plurality of rows of horizontal rails spaced about the backing height and extending from the left rail to the right rail and generally parallel to the backing width, each horizontal rail located about 0.75 inches to about 1.25 inches above a respective one of the ledges; and b) a fastener configured to attach the storage rack to the interior surface of the cabinet door;

wherein each ledge comprises a left side flush with the left rail and a right side flush with the right rail and further wherein each ledge comprises a top surface, a bottom surface, a ledge height extending from the top surface to the bottom surface and generally parallel to the backing height, and a v-shaped groove located on the top surface and extending along the length of each ledge, wherein the backing extends from the left rail to the right rail, and further wherein the backing extends between the plurality of ledges.

20. The low profile storage rack system of claim 19 wherein the system further comprises at least one generally rectangular bag, the at least one generally rectangular bag having a bag bottom end located in a respective one of the v-shaped grooves, a bag top end, and a bag middle portion.

21. A low profile storage rack system comprising:

a) a storage rack comprising:

i) a backing comprising a rear surface configured to confront an interior surface of a cabinet door, a front surface opposite the rear surface, a backing thickness extending from the front surface to the rear surface, a backing top end, a backing bottom end, a backing height extending from the backing top end to the backing bottom end, a backing left side, a backing right side, a backing width extending from the backing left side to the backing right side;

ii) a plurality of rows of ledges extending generally perpendicular relative to the backing height, each ledge flush with the front surface and having a ledge length generally parallel to the backing width and a median ledge depth generally parallel to the backing thickness, the median ledge depth of each ledge being from about 0.5 inches to about 0.75 inches;

iii) a left rail extending from the front surface of the backing generally perpendicular to the backing width, the left rail comprising a left rail height generally parallel to the backing height;

iv) a right rail extending from the front surface of the backing generally perpendicular to the backing width, the right rail comprising a right rail height generally parallel to the backing height; and v) a plurality of rows of horizontal rails spaced about the backing height and extending from the left rail to the right rail and generally parallel to the backing width, each horizontal rail located about 0.75 inches to about 1.25 inches above a respective one of the ledges;

b) a fastener configured to attach the storage rack to the interior surface of the cabinet door; and c) a plurality of generally rectangular bags, each bag having a bag bottom end, a bag top end, and a bag middle portion located between the bag top end and the bag bottom end, wherein each ledge comprises a left side flush with the left rail and a right side flush with the right rail, wherein each ledge further comprises a raised lip extending upwardly from the ledge, each raised lip extending from the left rail to the right rail, each raised lip comprising a lip height generally parallel to the backing height, wherein the backing extends from the left rail to the right rail, wherein the backing extends between the plurality of ledges, and further wherein each ledge comprises a top surface, and a v-shaped groove located on the top surface and extending along the length of the ledge.

* * * * *